United States Patent [19]

Lorenzana et al.

[11] Patent Number: 5,037,055

[45] Date of Patent: Aug. 6, 1991

[54] COMBINED SOAP CONTAINER AND MIRROR CLEANER

[76] Inventors: Moises B. Lorenzana, 601 Lake Hinsdale Dr., 310 F, Willowbrook, Ill. 60514; Vance A. Lorenzana, 698 Springhill Cir., Naperville, Ill. 60540

[21] Appl. No.: 40,816

[22] Filed: Apr. 21, 1987

[51] Int. Cl.[5] ..... A47G 29/00

[52] U.S. Cl. ..... 248/309.1; 15/257 R; 206/77.1

[58] Field of Search ..... 248/309.1, 311.2, 346, 248/346.1, 359; 211/88, 14; 15/257 R, 245, 244 R, 246, 105; 206/77.1, 207, 214

[56] References Cited

U.S. PATENT DOCUMENTS

| | | | |
|---|---|---|---|
| 295,436 | 3/1884 | Schoenau | 206/77.1 X |
| 2,399,533 | 4/1946 | Albright | 206/77.1 X |
| 3,600,740 | 8/1971 | Ogier | 15/257 |
| 3,929,312 | 12/1975 | Uke | 248/346.1 |
| 4,075,730 | 2/1978 | Siemund | 15/245 |
| 4,491,234 | 1/1985 | Wilcock | 15/257 R X |

*Primary Examiner*—Alvin C. Chin-Shue
*Attorney, Agent, or Firm*—Neil M. Rose

[57] ABSTRACT

A combination soap dish and squeegee including a cup shaped tray for receiving a bar of soap and having a wall thereof slotted to provide a passageway for receiving the blade portion of a squeegee and an upwardly facing channel to support the handle portion of the squeegee.

9 Claims, 1 Drawing Sheet

COMBINED SOAP CONTAINER AND MIRROR CLEANER

BACKGROUND OF THE INVENTION

The invention relates generally to a soap container of the type used to contain a cake of soap in the kitchen or bathroom and relates specifically to a soap dish combined with means for removing moisture from a mirror, removing liquid and debris from a kitchen counter top and for performing other similar tasks.

It has been well known in the art to provide means for containing and storing a cake of soap either in the bathroom or kitchen where such items of soap are normally used. It is considered desireable to provide such container or storage means so that the cake of soap which is soluable in water will be positioned to allow water to drain off its surface while it is not in use. Since there is often some residue associated with the water draining off the soap, it is preferred to have the residue drain into a container which may be easily cleaned. Although in some instances the sink may have built in or integrally formed pockets or recesses in which a cake of soap may be stored; however, such pockets or recesses present added cleaning problems in so far as removing the residue that is left from the draining of the soap.

Another problem associated with bathrooms and kitchens is the condensation of moisture that occurs on mirrors and other surfaces as a consequence of the high humidity in such areas as a consequence of hot water being run in a shower or bath. The removal of such condensation is often difficult since the pervasive high humidity interferes with attempts to remove the condensation. While it is recognized that a squeegee or flexible resilient blade can be effective in removing moisture from a surface such as a mirror, such means are not usually conveniently available in a bathroom or kitchen.

There are also occasions in both the kitchen and the bathroom in which water is inadvertently splashed on the walls or counter top. It is desireable to remove such water rather than merely allowing it to evaporate since after evaporation there are frequently unsightly stains or deposits remaining as a result of the impurities in the water.

SUMMARY OF THE INVENTION

The present invention is directed to a soap dish having a soap receiving receptacle and means in said receptacle to support a squeege, such support positioning the blade of the squeegee extending downwardly in an enclosure formed by the walls of said receptacle. The support means for the squeegee includes a passageway in one wall of the soap dish whereby the handle portion of the squeegee is supported above the wall of the soap dish while the blade of the squeegee is contained within the enclosure formed in the walls of the soap dish so that moisture and residue dripping from the blade of the squeegee will be contained within said enclosure. Accordingly, it is an object of the present invention to provide an improved combined soap storage dish and a squeegee for use in removing moisture from mirrors and the like.

It is a further object of the present invention to provide an improved soap dish and squeegee which is compact and convenient for use in any bathroom.

Another object of the invention is to provide an improved soap dish and squeegee wherein the squeegee will be conveniently supported for easy use and in the storage position of the squeegee the blade will be condealed within the enclosure formed by the walls of the soap dish.

It is a further object of the present invention to provide an improved soap dish which includes a rubber bladed scraper which is useful in the kitchen to clean sinks and counter tops, the soap dish including means to store the scraper with the blade concealed and our of sight.

BRIEF DESCRIPTION OF THE DRAWINGS

Other objects and advantages of the present invention will become apparent from the following detailed description and the appended drawings in which:

Referring to FIG. 1 there is shown a combined soap container and mirror cleaner designated generally as 11 and which includes a soap container 13 and a mirror cleaner or squeegee 15. The soap container or dish 13 has a generally rectangular pocket or recess 17 which is defined by a corrugated bottom wall 19, front wall 21, side walls 23 and 25 and rear wall 27. The recess 17 is of a suitable size to receive and store a conventional cake or bar of soap. The bottom 19 is provided with a plurality or parallel, upwardly facing channels 29 which are separated by common walls 31. The upper edges of the walls 31 extend horizontally when the container 13 is supported on the horizontal surface of a sink or kitchen counter top. The walls 31 engage and support a bar of soap providing the channels into which liquid or residue may drain after the soap has been used.

The walls 21, 23, 25 and 27 are double thickness having inner walls 21*a*, 23*a*, 25*a* and 27*a* defining the pocket or recess 17, and outer walls 21*b*, 23*b*, 25*b* and 27*b* which define the outer surface of the soap container 13. The walls 21*b*, 23*b*, 25*b* and 27*b* terminate at their lower edges in a horizontal plane forming the base or support for the container 13.

Figure 4:
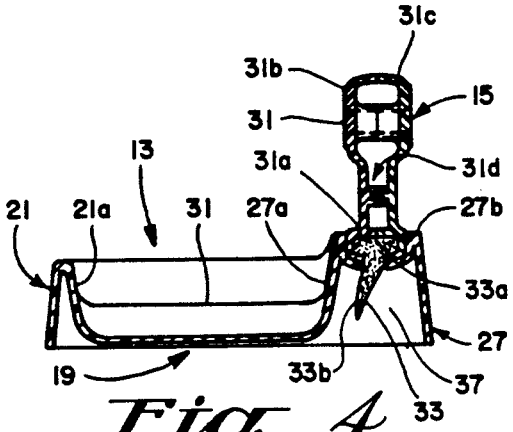
FIG. 4 is a sectional view taken on line 4—4 of FIG. 3.

The squeegee 15 is made up of a handle 31 and a resilient blade 33. The blade 33 is generally T-shaped in cross-section as shown in FIG. 4 having a mounting rib 33*a* and a flexible tapered portion 33*b*. The mounting rib 33*a* is received in an elongated recess 31*a*. The handle 31 is formed by two identical housing halves 31*b* and 31*c* which are positioned with respect to each other by the engagement of mating projections and recesses 31*d*. The handle 31 has a wide gripping portion 31*c* at its upper portion and a reduced thickness portion 31*f*. At the lower edge of the handle 31 there is provided a mounting rib 31*g* which is received in an elonged slot 35 to mount the squeegee in a vertical position with respect to the soap container 13. The slot 35 is formed with internal ribs 37 which facilitate insertion and removal of the squeegee from its mounted position within the slot 35.

Figure 1:
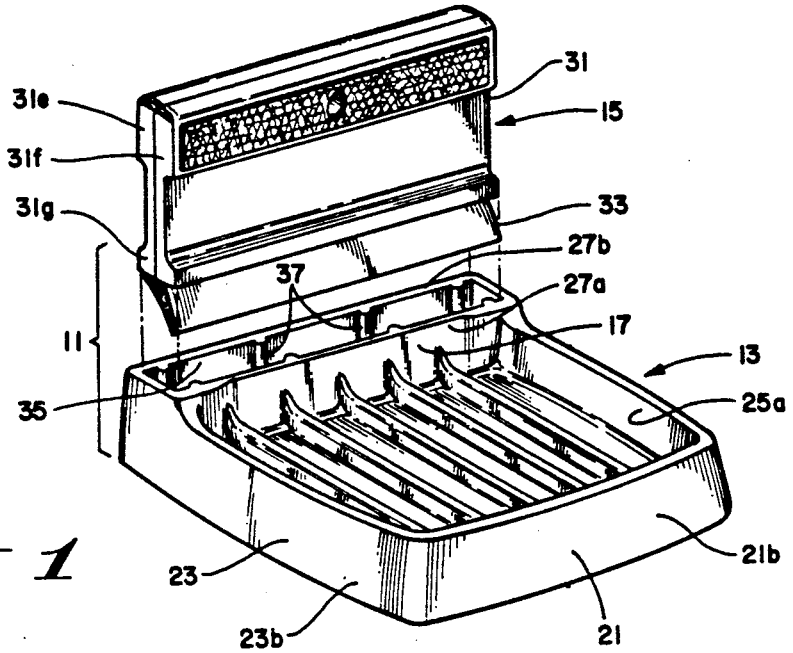
FIG. 1 is an exploded perspective of a soap dish and squeegee embodying my invention.
Figure 2:
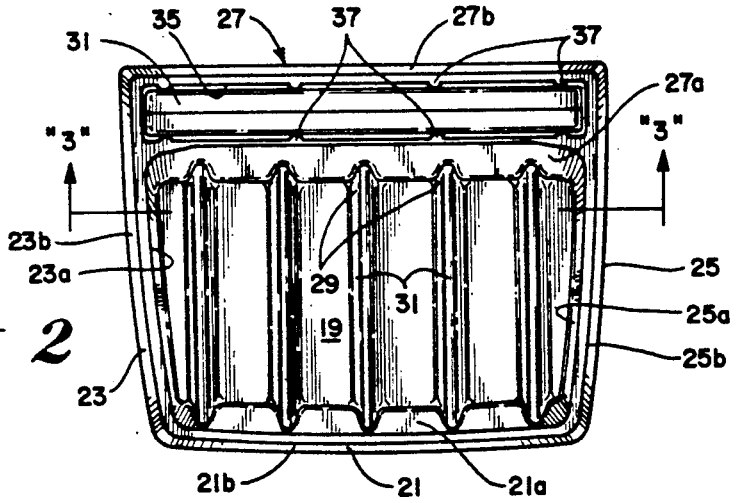
FIG. 2 is a top plan view of the soap dish and squeegee of FIG. 1.
Figure 3:
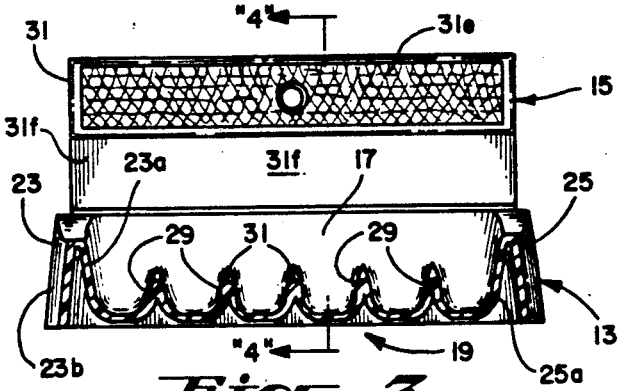
FIG. 3 is a sectional view taken on line 3—3 of FIG. 2.

From the foregoing, it may be understood that the soap dish 13 performs the dual function of receiving and storing soap in the recess 17 as well as supporting and storing the squeegee 15. When the squeegee 15 is in its storage position as shown in FIGS. 3 and 4, the blade 33 of the squeegee is within a downwardly facing cavity or passageway 38 formed between the wall 27*a* and wall 27*b* or between the outer rear wall 27*b* and the bottom wall 19. As so positioned any residue picked up on the blade 33 will fall within the confines of the walls of the soap dish 13 in a desired manner. The combined soap dish and squeegee provides a useful and practical accessory to the bathroom in accomodating in a single simple device several functions not otherwise provided for.

The combined soap dish and squeegee is also a very useful accessory for the kitchen where the squeegee may be used as a scraper as well. Thus for scraping table scraps from plates into the sink or garbage disposal, the storage of the squeegee in the soap dish makes it conveniently available whenever it may be needed. The flexible blade of the squeegee is also suitable for removing or collecting moisture which may have been splashed onto either the walls or kitchen counter top. The debris left on the counter top during food preparation may also be scraped up and disposed of using the rubber bladed squeegee. In summary, the combined soap dish and squeegee has substantial utility in both the kitchen and the bathroom where the convenience and advantages of having the soap dish and squeegee/scraper combined in one utensil are realized.

What is claimed as new and desired to be secured by Letters Patent of the United States is:

1. A combination utensil for storing soap and for removing condensation from a mirror comprising a one piece soap dish having a corrugated bottom surrounded by peripheral side walls, said bottom and side walls defining a shallow recess of a size to partially enclose a cake of soap, said side walls extending above and below said bottom terminating in an edge which forms a base for supporting said utensil on a horizontal surfae, said side walls defining front, rear and end walls around said bottom, said rear wall having a slot adjacent to its upper edge which provides access to a passageway formed between said bottom and said rear wall, said passageway and said slot extending across the length of said rear wall and being open downwardly to the area of a surface enclosed by said base, a squeegee having an elongated flexible blade and a handle, said squeegee being supported by said soap dish with said handle received in said slot and said blade disposed in said passageway, said slot and said blade and said squeegee handle being substantially coextensive with said rear wall and said recess.

2. The combination of claim 1 wherein said side walls are formed by inner and outer walls providing an annular chamber surrounding said bottom, said passageway forming a part of said annular chamber.

3. The combination of claim 1 wherein said rear wall is formed with an elongated upwardly facing channel with said slot being defined in the bottom of said channel and substantially coextensive therewith, said squeegee being received in said channel with said blade extending through said slot, said portion of said rear wall forming said channel engaging said handle to support said squeegee in an upright position with said handle extending upwardly and said blade extending downwardly.

4. The combination of claim 1 wherein said handle comprises a pair of generally flat elongated members which abut on a central vertical plane to form a grip portion extending along one edge of said handle, a thin finger engaging portion intermediate the edges of said handle and a slotted other edge which receives and supports said flexible blade.

5. The combination of claim 4 wherein said blade is formed with a mounting portion gripped between said handle members and a tapered flexible portion which extends downwardly from said mounting portion and which tapers from said mounting portion downwardly to a knife edge.

6. The combination of claim 5 wherein said blade has a generally T-shaped cross-section taper normal to the length of said handle member, said mounting portion being generally perpendicular to said blade, said handle member having opposed channel shaped recesses which receive and grip said mounting portion.

7. The combination of claim 3 wherein said upwardly facing channel in said rear wall is formed with a series of spaced protuberances which engage said handle at spaced intervals to support said squeegee.

8. A soap holding appliance comprising an upwardly facing dish of generally rectangular pan shape having walls with a top and bottom and a size adapted to receive a cake of soap, the bottom of said dish having a plurality of ribs on which said soap is supported out of contact with any drained water, at least one wall of said dish being formed with a slot which provides access to a passageway extending from the slot of said wall to the bottom of said wall, a squeegee having a handle portion and a blade, said slot receiving and supporting the handle portion of said squeegee with the blade portion extending downwardly so that moisture dripping from said blade will fall through said appliance onto a surface that may be used for support purposes, said slot and said passageway extending across the length of said one wall, said squeegee being substantially coextensive with said slot pocket.

9. The combination of claim 8 including three side walls in addition to said one wall, said walls forming an enclosure within which said blade is supported, said walls terminating at their lowermost edges in a common plane providing a support base for said appliance.

* * * * *